US006773042B2

(12) United States Patent
Spurr et al.

(10) Patent No.: US 6,773,042 B2
(45) Date of Patent: Aug. 10, 2004

(54) LATCH ASSEMBLY

(75) Inventors: Nigel Victor Spurr, Solihull (GB); Morten Ketelsen, Birmingham (GB); Peter Coleman, Birmingham (GB)

(73) Assignee: Meritor Light Vehicle Systems (UK) Limited, Stirchley (GB)

( * ) Notice: Subject to any disclaimer, the term of this patent is extended or adjusted under 35 U.S.C. 154(b) by 0 days.

(21) Appl. No.: 10/131,586

(22) Filed: Apr. 24, 2002

(65) Prior Publication Data

US 2002/0167178 A1 Nov. 14, 2002

(30) Foreign Application Priority Data

Apr. 28, 2001 (GB) ..... 0110456

(51) Int. Cl.[7] ..... E05B 65/32

(52) U.S. Cl. ..... 292/216; 292/201; 292/DIG. 23; 292/DIG. 65; 292/DIG. 62

(58) Field of Search ..... 292/216, DIG. 23, 292/201, DIG. 65, 144, DIG. 62; 70/277; 74/89.17; 318/432, 434

(56) References Cited

U.S. PATENT DOCUMENTS

| | | | | | |
|---|---|---|---|---|---|
| 3,479,767 | A | * | 11/1969 | Gardner et al. | 49/280 |
| 4,783,053 | A | * | 11/1988 | Yirmiyahu et al. | 254/93 R |
| 5,107,194 | A | * | 4/1992 | Poehlein | 318/696 |
| 5,114,197 | A | * | 5/1992 | Persiani | 292/336.3 |
| 5,118,146 | A | * | 6/1992 | Watanuki | 292/216 |
| 5,280,881 | A | * | 1/1994 | Karmin | 70/279.1 |
| 5,419,596 | A | | 5/1995 | Okada et al. | |
| 5,632,120 | A | | 5/1997 | Shigematsu et al. | |
| 5,956,998 | A | * | 9/1999 | Fenelon | 74/89.17 |
| 6,021,691 | A | * | 2/2000 | Wilkerson, Jr. | 74/547 |
| 6,109,671 | A | * | 8/2000 | Roncin et al. | 292/216 |
| 6,354,121 | B1 | * | 3/2002 | Frolov | 70/277 |
| 6,390,517 | B1 | * | 5/2002 | Ehret | 292/201 |
| 6,412,584 | B1 | * | 7/2002 | Faigle et al. | 180/282 |
| 6,428,058 | B1 | * | 8/2002 | Graute | 292/216 |
| 6,431,617 | B1 | * | 8/2002 | Fisher | 292/216 |
| 6,435,573 | B1 | | 8/2002 | Szablewski | |
| 6,459,223 | B2 | * | 10/2002 | Mauel et al. | 318/445 |
| 6,550,831 | B2 | * | 4/2003 | Rizk | 292/336.3 |

FOREIGN PATENT DOCUMENTS

| | | |
|---|---|---|
| DE | 197 25 416 C1 | 1/1999 |
| DE | 197 10 531 A1 | 9/1999 |
| EP | 0 978 609 A1 | 2/2000 |
| EP | 1 074 681 A1 | 2/2001 |
| EP | 1 081 320 A1 | 3/2001 |
| GB | 2 123 476 A | 2/1984 |
| GB | 2 337 555 A | 11/1999 |

OTHER PUBLICATIONS

European Search Report Dec. 15, 2003.
Search Report Under Section 17 dated Jul. 26, 2001.

* cited by examiner

*Primary Examiner*—Robert J. Sandy
*Assistant Examiner*—Thomas Ho
(74) *Attorney, Agent, or Firm*—Carlson, Gaskey & Olds

(57) ABSTRACT

A latch assembly (10, 110, 210, 310) for releasably securing a door in a closed position, the assembly comprising an actuator (15, 115, 215, 315) with an actuator output, the actuator having a first relatively fast acting low force output mode and a second relatively slow acting high force output mode, the actuator output being interconnected with a latch bolt (46, 146, 246, 346) of the assembly such that the latch bolt may be relatively rapidly released by the actuator operating in its first output mode when the load required to unlatch the latch bolt is relatively low, but relatively slowly unlatched by the second output mode when the load required to unlatch the latch bolt is relatively high.

15 Claims, 4 Drawing Sheets

LATCH ASSEMBLY

This application claims priority to United Kingdom (GB) Patent Application No. 0110456.1 filed on Apr. 28, 2001.

BACKGROUND OF THE INVENTION

The present invention relates to a latch assembly. More particularly, the present invention relates to a latch assembly having an actuator with two output modes.

The present invention is particularly, although not exclusively, applicable to latches used on vehicle doors such as car passenger doors, tailgate doors or car trunk doors.

Vehicle door latches are known which are released using a power actuator.

From the point of the view of vehicle users, it is desirable that the unlatching of a vehicle door is achieved rapidly so that the user is not required to wait before they may enter the vehicle.

When the door is latched, the seals around the door exert an outward force tending to open the door that is reacted at the interface between the striker and latch bolt. This is commonly known as the 'seal force'. The configuration of conventional latch assemblies is such that an increased seal force in turn requires an increased unlatching force to be applied to unlatch the latch bolt. Thus, when the seal force is relatively low, a drive means with a relatively low power output is capable of rapidly unlatching the latch bolt to permit vehicle entry.

However, if the seal force is increased due to, for example, the buckling of the door in an impact, an attempt by the drive to rapidly unlatch the door is liable to cause the drive to stall and the door thus to remain latched. In order to overcome this problem, is has hitherto been necessary to provide a more powerful drive, which inevitably increases the cost of a latch assembly, or to slow the rate of unlatching so that a less powerful drive may provide an increased unlatching force that will overcome the higher seal force and thus permit unlatching to occur.

SUMMARY OF THE INVENTION

The present invention seeks to provide a latch arrangement having a relatively low power drive that can be rapidly unlatch the door under normal conditions, and yet provide high unlatching forces in high seal force conditions.

Accordingly, one aspect of the present invention provides a latch assembly for releasably securing a door in a closed position, the assembly comprising an actuator with an actuator output, the actuator having a first relatively fast acting low force output mode and a second relatively slow acting high force output mode, the actuator output being interconnected with a latch bolt of the assembly such that the latch bolt may be relatively rapidly released by the actuator operating in its first output mode when the load required to unlatch the latch bolt is relatively low, but relatively slowly unlatched by the second output mode when the load required to unlatch the latch bolt is relatively high.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
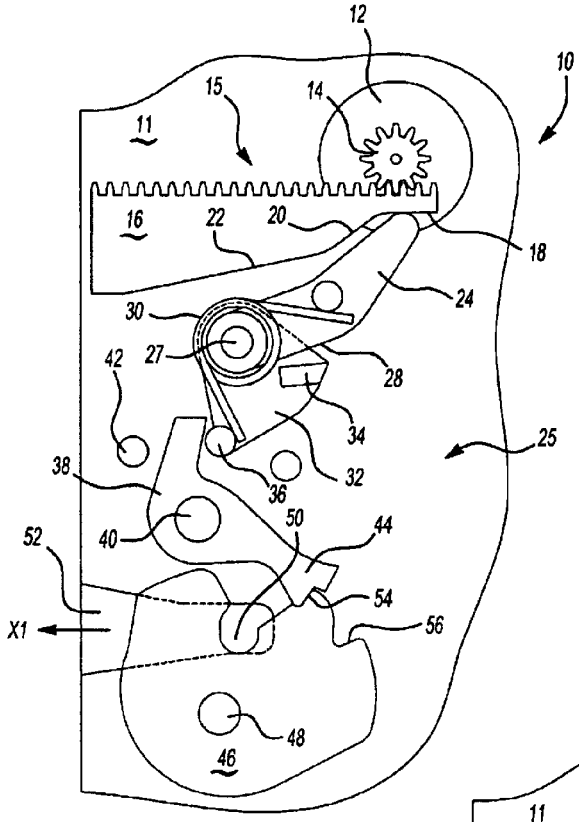
FIG. 1 is a view of a latch assembly according to one version of the present invention in a closed condition with a low seal force.

With reference to FIG. 1 there is shown a latch assembly 10 comprising a power actuator 15, a linkage 25 and a latch bolt 46 mounted on a plate 11. Normally, the latch assembly 10 would be mounted on a door (not shown) in use.

In this version, the actuator comprises a motor 12 drivingly connected to a pinion 14 which in turn drivingly engages a rack provided on one edge of a cam 16. The opposite edge of the cam 16 is preferably provided with three distinct surfaces constituting the cam profile. In this version, the cam surfaces constitute the output of the actuator. The first surface 18 extends substantially parallel to the axis of travel of the cam, the second surface 20 has a relatively steep incline with respect to surface 18 and the third surface 22 has a relatively shallow incline with respect to surface 18.

A cam follower 24 is pivotally mounted to plate 11 about pivot 27. A member 32 is also pivotally mounted to plate 11 by pivot 27. Resilient member, which in this version is a coil spring 30 is arranged about the pivot 27 so as to urge cam follower 24 anticlockwise and member 32 in clockwise directions. In order to prevent the spring 30 causing the unlatching of the latch bolt via a pawl 38 described in greater detail below, a stop (not shown) is preferably provided that prevents member 32 rotating in an anti-clock wise direction relative to follower 24 beyond a predetermined angle. The rotation of cam follower 24 clockwise relative to member 32 against the action of spring 30 is limited by a further stop 34 that engages with surface 28 of the cam follower 24.

Pawl 38 is pivotally mounted for rotation about pivot 40 and is biased in a clockwise direction into contact with latch bolt 46 by resilient means (not shown). The end of the pawl 38 remote from member 32 includes a pawl tooth 44 for engagement with primary and secondary latching abutments 54 and 56 of the latch bolt 46. In this version, latch bolt 46 is of the rotating claw type, having a mouth 50 and being pivotally mounted on plate 11 about pivot 48. Plate 11 also includes a mouth 52 which in conjunction with the mouth 50 provides for the retention and release of a striker pin (not shown) mounted on an associated door aperture. The latch bolt is preferably resiliently biased to bring the mouth 50 into its open position.

Figure 2:
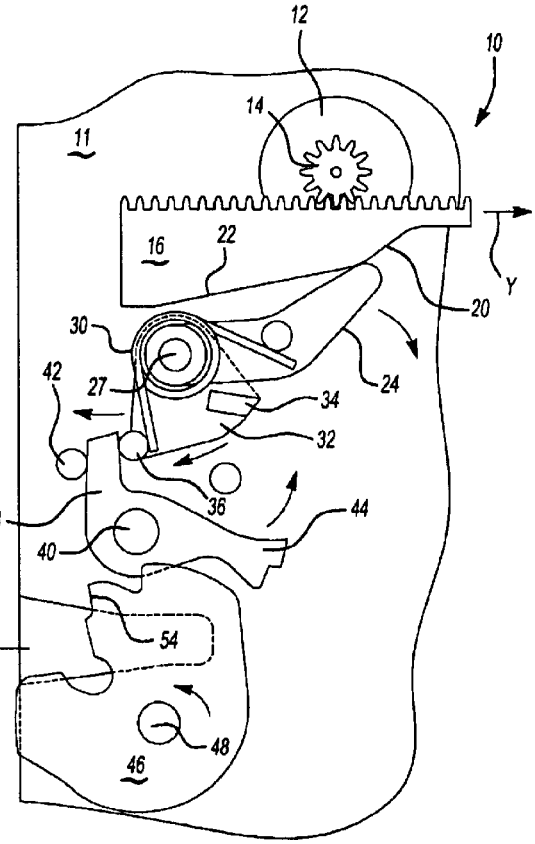
FIG. 2 is a view of the latch assembly of FIG. 1 shown in an unlatching condition.

In use, a user wishing to open the door causes motor 12 to be energized, which in turn drives cam 16 in the direction Y shown in FIG. 2. This causes cam follower 24 to rotate clockwise as it climbs the steeply inclined cam surface 20. As the power output of the motor is fixed, the unlatching force transmitted through the linkage 25 whilst the follower 24 is in contact with surface 20 is relatively low.

In this embodiment, the contact of the follower with surface 20 constitutes a first output mode of actuator 15.

In FIG. 2, the seal force X1 acting on claw 46 is within normal operating range which could be expected to be between 300 and 600 N. Thus, the frictional resistance acting to prevent disengagement of pawl 244 from the primary latching abutment 54 is also relatively low and is less than the threshold force required to cause spring 30 to deflect. Therefore, as shown in FIG. 2, the rotation of cam follower 24 causes member 32 to rotate clockwise and pawl 38 to rotate anti-clock wise thus rapidly disengaging pawl tooth 44 from primary latching abutment 54. In turn, this enables claw 46 to rotate anti-clock wise, thus releasing the striker and enabling the door to be opened.

In one version, the cam then continues to be driven until the end of surface 22 is reached, before being reset to its starting position by reversing the motor drive. In an alternative class of embodiments, a sensor may be provided to ensure that the drive ceases once unlatching has been achieved and the cam position is then reset from that point.

Figure 3:
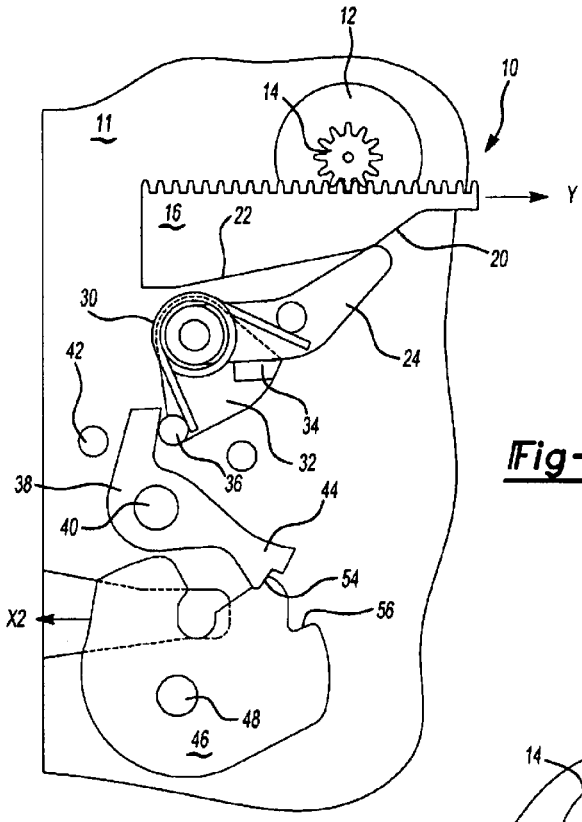
FIG. 3 is a view of the latch assembly of FIG. 1 with a high seal force and in a latched condition.

Turning now to FIG. 3, it can be seen that an increased force X2 is acting on claw 46. Thus, when cam follower 24 is driven up surface 20, the frictional resistance to the disengagement of pawl tooth 44 from the primary latching abutment 54 is greater than the force required to deflect spring 30. Therefore up until the point that cam follower 24 reaches the intersection of surfaces 20 and 22, the remainder of the linkage remains stationary and the door remains latched. However, further deflection of spring 30 is prevented by the engagement of surface 28 with the stop 34 of member 32.

Figure 4:
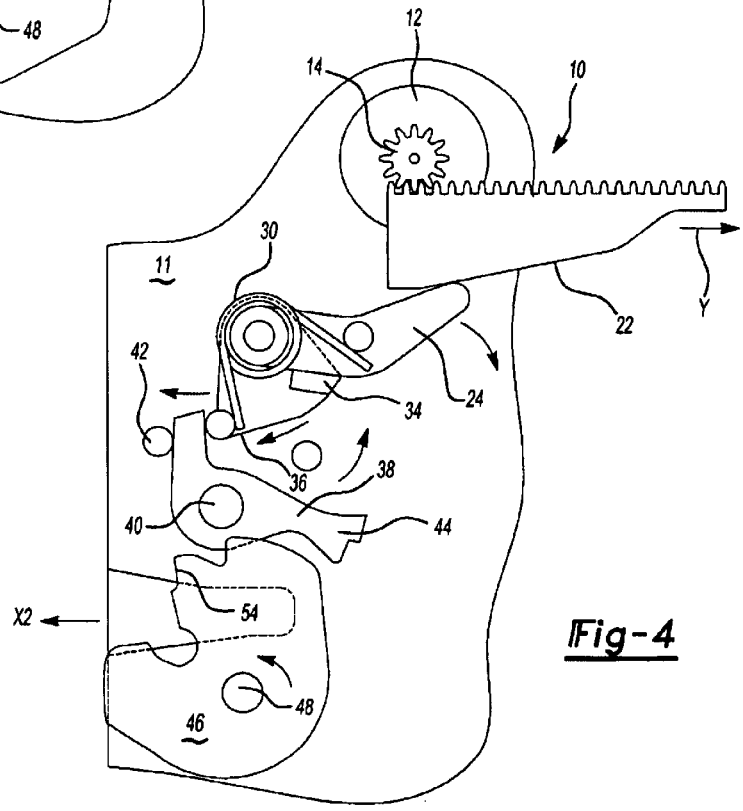
FIG. 4 is a view of the latch assembly of FIG. 3 shown in an unlatching condition.

Referring now to FIG. 4, as the motor continues to drive cam 16 in a direction Y, follower 24 then follows shallow inclined cam surface 22 constituting the second output mode of actuator 15. This means that the angular velocity of follower 24 is reduced but an increased unlatching force is transmitted through the follower 24 (via surface 28 and stop 34) and member 32 which are now caused to rotate in unison. The increased force is then transmitted to pawl 38 and is sufficient to overcome the increased frictional resistance to the disengagement of pawl tooth 44 from abutment 54. As can be seen from FIG. 4, once the pawl 44 has been disengaged, claw 46 is free to rotate and release the striker pin thereby enabling the door to be opened. Once unlatched, the apparatus is then reset in a similar manner to that described above.

Figure 5:
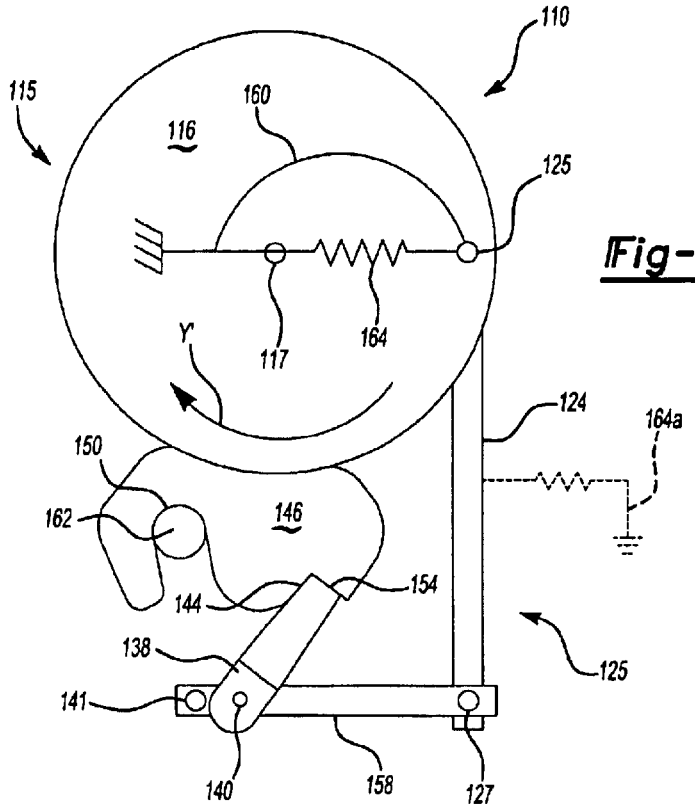
FIG. 5 is a view of a latch assembly according to another embodiment of the present invention in a latched condition.
Figure 6:
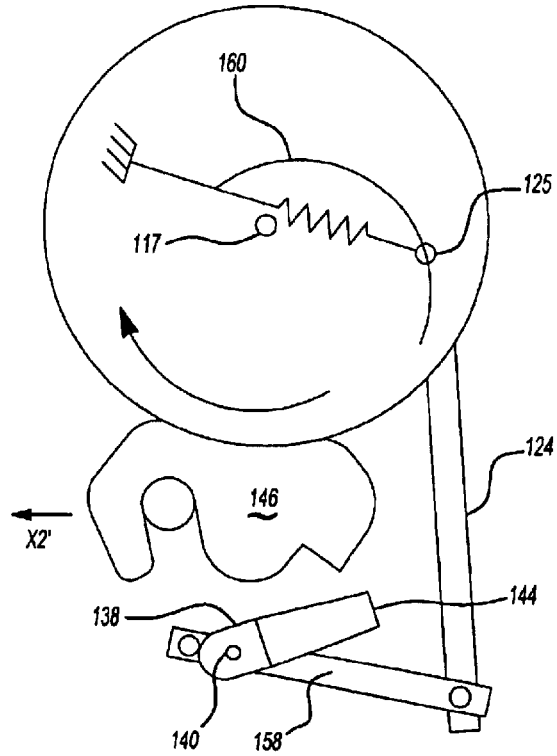
FIG. 6 is a view of the latch assembly of FIG. 5 shown in an unlatching condition with a high seal force.

Turning now to a second version of the present invention as illustrated in FIGS. 5 and 6, like parts have, where possible, been designated by like numerals of the first embodiment, but with the addition of the prefix 1.

Referring to FIG. 5, it can be seen that the latch 110 comprises a rotatable claw 146 having a mouth 150 to receive and releaseably retain a striker 162. The claw further comprises a latching abutment 154 arranged to be engaged by pawl tooth 144 of pawl 138 that is rotatable about pivot 140. The pawl is biased into contact with the claw 146 by biasing member (not shown) such as a helical spring.

A linkage comprising first and second arms 124 and 158 respectively interconnects the pawl 138 and a gear 116 of actuator 115. One end of arm 158 is pivotally mounted to pin 140 and a drive dog 141 is arranged to engage an edge of pawl 138 such that clockwise movement of arm 158 also results in clockwise movement of the pawl.

The other end of arm 158 is pivotally mounted to one end of arm 124 by pivot pin 127. The other end of arm 124 has a pin 125 mounted thereon. Pin 125 is mounted for slideable movement within schematically illustrated slot 160 on actuator gear 116. Pin 125 is resiliently biased towards the radially outer edge of gear 116 by biasing member in the form of a helical compression spring illustrated schematically at 164, with the other end of the spring being secured to a fixed point the gear 116. It can be seen that the slot 160 has an arcuate profile whose radius of curvature is variable over its length. In other versions, the compression spring 164 may fit within slot 160.

In operation, the latch starts in a latched condition shown in FIG. 5 and to achieve unlatching, actuator gear 116 is driven in a clockwise direction Y' by drive means such as an electric motor (not shown).

Under normal seal loads, the frictional resistance that must be overcome to release pawl tooth 144 from abutment 154 is relatively low, meaning that as rotation of gear 116 occurs, the resilient resistance of spring 164 is not overcome and pin 125 remains in its radially outermost position. This means that this disengagement of the pawl tooth 144 may be achieved relatively rapidly since the lever arm or effective lever length between the center of rotation 117 of gear 116 and the position of pin 125 is at its greatest meaning that pin 125 is translated by the greatest, possible amount for a given unit of angular rotation of gear 116. This mode of operation constitutes a relatively fast acting, low force output mode.

If, however, the frictional resistance to the disengagement of pawl tooth 144 from abutment 154 is increased, a greater output force must be supplied by the actuator to achieve unlatching. Due to the increased resistance, and the shape of slot 160, spring 164 is caused to compress and thus the lever arm between pin 125 and the center of rotation 117 of gear 116 is reduced, meaning that the actuator 115 supplies an increased unlatching force to overcome the frictional resistance between pawl tooth 144 and abutment surface 154, albeit at a lower unlatching rate.

The pin in slot arrangement enables the actuator to provide the optimum force to the pawl tooth 144 such that for a given the amount of energy supplied to the actuator, the fastest possible unlatching may occur. It will be appreciated that the length and shape of the slot 160, power output and gearing of the motor and the resilience of the spring 164 all may be adjusted to provide the appropriate ranges of unlatching force and unlatching speed for a given latch. In other versions, there may be no pre-loading on spring 164, meaning that any frictional resistance to the disengagement of the pawl tooth 144 will cause compression of the spring. As a further alternative, spring 164 may be replaced by a tension spring **164*a* illustrated in broken lines in FIG. 5 and which is secured to the mounting plate (not shown) of the latch 110**.

A sensor (not shown) may be provided in the latch assembly 110 to detect when disengagement of the pawl tooth 144 is achieved and drive from the actuator may then cease. Alternatively, the actuator may be caused to drive to its full extent of rotation before drive is caused to cease (e.g. by monitoring changes in current to the motor and detecting a change in this when the motor stalls). In both cases, the actuator is then back driven, either by reversing the actuator motor, or by use of resilient member (not shown) to return to its rest position. In other versions, a clutch may be provided between the motor and the actuator gear 116 so that back-driving the motor is not necessary.

Figure 7:
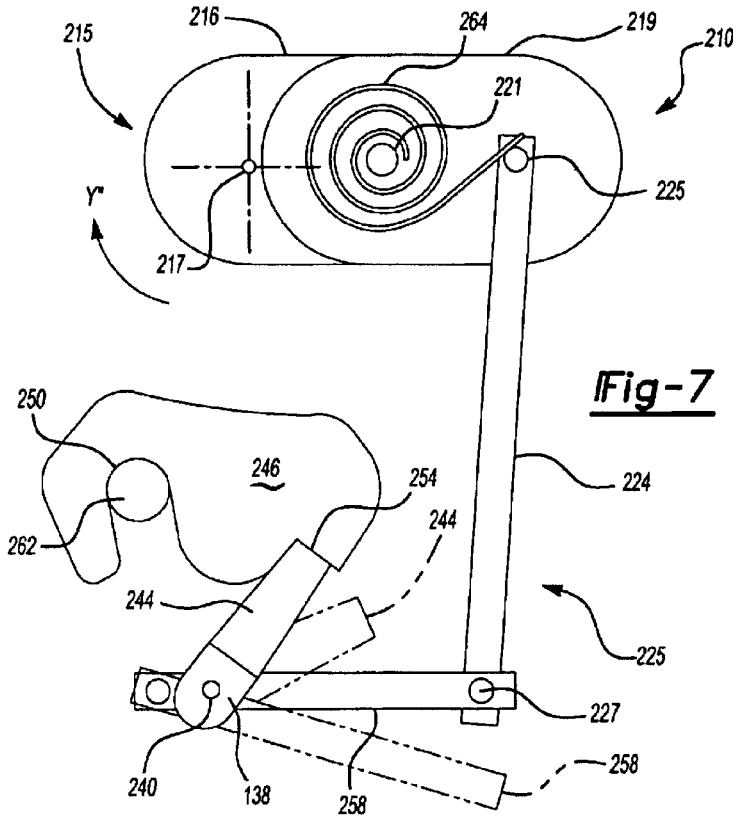
FIG. 7 is a view of a latch assembly according to a third embodiment of the present invention in a latched condition.

Referring now to FIG. 7 in which like parts have, where possible, been denoted by like numerals with the addition of the prefix "2". Only differences between the embodiment of FIG. 7 and the embodiment of FIGS. 5 and 6 will therefore be discussed in more detail.

It is apparent that the pin and slot arrangement of the second embodiment has been replaced by a pivoted link arrangement comprising a first link 216 mounted to be driven by a drive (not shown) about point 217. First link 216 is pivotally mounted to second link 219 about pin 221 remote from point 217, with linkage 224 being further pivotally mounted to the second link 219 about pin 225 remote from pin 221. First and second links 216 and 219 are biased into a substantially parallel relationship of their longitudinal axes by torsion spring 264 mounted about pin 221.

In operation, the drive rotates link 216 in a clockwise direction Y". If the unlatching force required is relatively low, the resilience of spring 221 is not overcome, the rotation of link 216 is translated to substantially linear movement of linkage member 224, with links 216 and 219 remaining mutually parallel. However, if the required unlatching force is increased for any reason, the resistance to unlatching causes link 219 to pivot anticlockwise in relation to link 216, thereby shortening the effective lever length between point 217 and pin 225. This increases the unlatching force at the expense of the speed at which unlatching is achieved. Thus, it can be seen that the arrangement of the third embodiment also self-regulates the relationship between the output force supplied by actuator 215 to achieve unlatching, and the output speed of the actuator. The position of pawl tooth 244 and second linkage member 258 when released is illustrated in broken lines in FIG. 7.

A similar arrangement to the second embodiment maybe provided to enable the actuator to return to its rest position once unlatching has been achieved.

Figure 8:
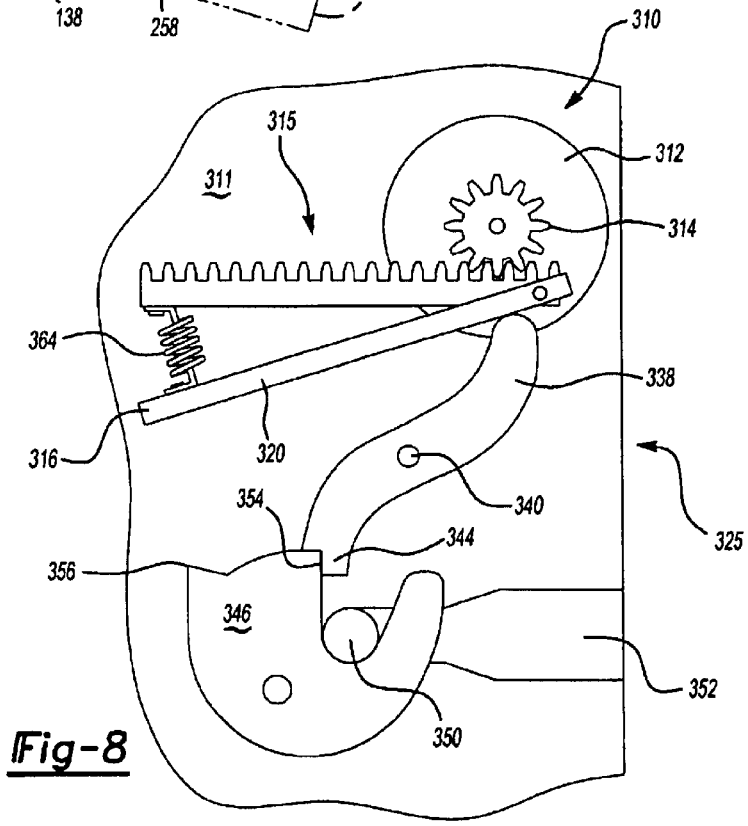
FIG. 8 is a view of a latch assembly accordingly to a fourth embodiment of the present invention in a latched condition.

Referring to FIG. 8, in which like parts have, where possible been denoted by like numerals with the addition of the prefix "3" and in which the assembly is a modification of the version of FIGS. 1 to 4, the fixed arrangement of cam surfaces 18, 20, 22 is replaced by a single surface 320 resiliently biased at an angle to the direction of travel of cam 316 by spring 364. It can be seen that the separate cam follower 24, coil spring 30 and member 32 arrangement of the first embodiment has been omitted since it is unnecessary, and that cam surface 320 directly drives one end pawl 338.

In low seal load conditions in which a low unlatching force is required, the unlatching force is insufficient to overcome the preloading on spring 364 when motor 312 is driven to cause unlatching, meaning that pawl 338 follows surface 320 when at its greatest angle, causing pawl tooth 344 to be disengaged from primary latching abutment 354 rapidly.

If the seal force is increased, spring 364 is compressed as motor 312 causes displacement of the cam 316, resulting in a shallower angle of surface 320 and a slower rate of disengagement of pawl tooth 344. As in the second and third versions of the present invention, the cam 316 of power actuator 315 self-regulates to achieve the optimum rate of unlatching for a given unlatching force.

It will therefore be apparent that the above described latching arrangements enable rapid unlatching of a door in normal conditions but still ensure that a door may be unlatched under high seal force conditions whilst using a relatively low power drive means.

It should be understood that numerous changes may be made within the scope of the invention. For example, a rotary rather than a linear cam may be used, as may a suitable alternative form of actuation having two separate output modes. Furthermore, alternative resilient member may be provided in the place of the spring and the apparatus may be adapted for use with alternative forms of latch bolts.

The aforementioned description is exemplary rather that limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. A latch assembly for releasably securing a door in a closed position, the assembly comprising an actuator with a resilient member and an actuator input and an actuator output, the actuator having a first relatively fast acting low force output mode and a second relatively slow acting high force output mode, the actuator output being interconnected with a latch bolt of the assembly through a mechanical linkage such that the latch bolt may be relatively rapidly released by the actuator operating in its first output mode when the load required to unlatch the latch bolt is relatively low, but relatively slowly unlatched by the second output mode when the load required to unlatch the latch bolt is relatively high, wherein the resilient member has sufficient resilience to transmit the low force though the mechanical linkage but insufficient resilience to transmit the high force.

2. A latch assembly according to claim 1 wherein the first and second output modes are provided in sequence.

3. A latch assembly according to claim 2 wherein the modes are provided in a predetermined sequence.

4. A latch assembly according to claim 1 wherein the actuator comprises a cam connected to a drive.

5. A latch assembly according to claim 1 wherein a stop is provided such that once the resilience of the resilient member has been overcome, the resilient member is bypassed.

6. A latch assembly according to claim 4 wherein the first output mode is achieved by a relatively fast acting profile portion of the cam.

7. A latch assembly according to claim 4 wherein the second output mode is achieved by a relatively slow acting profile portion of the cam.

8. A latch assembly according to claim 2 wherein the cam is a linear cam.

9. A latch assembly according to claim 2 wherein the cam is a rotary cam.

10. A latch assembly for releasably securing a door in a closed position, the assembly comprising an actuator with an actuator output, the actuator having a first relatively fast acting low force output mode and a second relatively slow acting high force output mode, the actuator output being interconnected with a latch bolt of the assembly such that the latch bolt may be relatively rapidly released by the actuator operating in its first output mode when the load required to unlatch the latch bolt is relatively low, but relatively slowly unlatched by the second output mode when the load required to unlatch the latch bolt is relatively high, the actuator converting from a rotary actuator input to a substantially linear actuator output wherein the actuator self-regulates the relationship between its output force and output speed by adjusting the effective lever length between the rotary actuator input and the actuator output.

11. A latch assembly according to claim 10 wherein a resilient member effects self-regulation.

12. A latch assembly according to claim 10 wherein the adjustment is achieved by a pin and slot arrangement.

13. A latch assembly according to claim 10 wherein adjustment is achieved by a pivoted link arrangement.

14. A latch assembly according to claim 12 wherein the resilient member biases the actuator output towards its greatest lever length.

15. A latch assembly for releasably securing a door in a closed position, the assembly comprising an actuator with a resilient member and an actuator output, for a given actuation input displacement, the actuator having a first relatively fast acting low force output mode and a second relatively slow acting high force output mode, the actuator output being interconnected with, a latch bolt of the assembly through a mechanical linkage such that the latch bolt may be relatively rapidly released by the actuator operating in its first output mode when the load required to unlatch the latch bolt is relatively low, but relatively slowly unlatched by the second output mode when the load required to unlatch the latch bolt is relatively high, wherein the resilient member has sufficient resilience to transmit the low force through the linkage but insufficient resilience to transmit the high force, wherein the actuator comprises a cam connected to a drive and the first output mode is achieved by a relatively fast acting profile portion of the cam.

* * * * *